US006233498B1

(12) United States Patent
King et al.

(10) Patent No.: US 6,233,498 B1
(45) Date of Patent: May 15, 2001

(54) METHOD OF AND SYSTEM FOR INCREASING DRILLING EFFICIENCY

(75) Inventors: Charles H. King; Mitchell D. Pinckard, both of Houston, TX (US); Jimmy L. Puckett, Lafayette, LA (US)

(73) Assignee: Noble Drilling Services, Inc., Sugar Land, TX (US)

( * ) Notice: Subject to any disclaimer, the term of this patent is extended or adjusted under 35 U.S.C. 154(b) by 0 days.

(21) Appl. No.: 09/035,458

(22) Filed: Mar. 5, 1998

(51) Int. Cl.[7] ..... G06F 19/00

(52) U.S. Cl. ..... 700/174; 700/83; 700/195; 702/45; 73/152.52

(58) Field of Search ..... 700/193, 163, 700/83, 195, 186, 71, 175, 176, 174, 111; 702/9, 102, 45; 73/152.52, 864.72, 152.19, 152.47

(56) References Cited

U.S. PATENT DOCUMENTS

| | | | | |
|---|---|---|---|---|
| 2,688,871 | | 9/1954 | Lubinski | 73/151.5 |
| 3,777,560 | | 12/1973 | Guignard | 73/151.5 |
| 3,802,259 | | 4/1974 | Eckels | 73/153 |
| 3,881,695 | | 5/1975 | Joubert | 254/172 |
| 3,882,474 | | 5/1975 | Cain | 340/177 |
| 4,354,233 | | 10/1982 | Zhukovsky et al. | 364/420 |
| 4,535,972 | | 8/1985 | Millheim et al. | 254/277 |
| 4,591,989 | * | 5/1986 | Tanaka | 700/176 |
| 4,689,775 | * | 8/1987 | Scherbatskoy | 367/83 |
| 4,736,297 | | 4/1988 | LeJeune | 364/420 |
| 4,793,421 | | 12/1988 | Jasinski | 175/27 |
| 4,843,875 | | 7/1989 | Kerbart | 73/151.5 |
| 4,875,530 | | 10/1989 | Frink et al. | 175/27 |
| 4,876,886 | | 10/1989 | Bible et al. | 73/151.5 |
| 4,886,129 | | 12/1989 | Bourdon | 175/40 |
| 4,976,019 | * | 12/1990 | Kitamura | 29/26 A |
| 5,105,130 | * | 4/1992 | Barker et al. | 318/268 |
| 5,159,577 | * | 10/1992 | Twist | 367/25 |
| 5,398,546 | | 3/1995 | Jeffryes | 73/151.5 |
| 5,449,047 | | 9/1995 | Schivley, Jr. | 175/27 |
| 5,458,207 | | 10/1995 | Mattero | 175/27 |
| 5,474,142 | | 12/1995 | Bowden | 175/27 |
| 5,551,286 | | 9/1996 | Booer | 73/152.45 |
| 5,679,894 | * | 10/1997 | Kruger et al. | 73/152.03 |
| 5,692,181 | * | 11/1997 | Anand et al. | 707/102 |
| 5,842,149 | * | 11/1998 | Harrell et al. | 702/9 |
| 5,881,310 | * | 3/1999 | Airhart et al. | 710/3 |
| 6,021,377 | * | 2/2000 | Dubinsky et al. | 702/9 |

* cited by examiner

*Primary Examiner*—William Grant
*Assistant Examiner*—Kidest Bahta
(74) *Attorney, Agent, or Firm*—Pillsbury Winthrop LLP

(57) ABSTRACT

A method of and system for increasing the efficiency of drillers in performing drilling operations measures performance parameters of drilling events performed by drillers, stores measurements of the performance parameters in a database, and displays a measurement of a selected performance parameter for a selected driller.

17 Claims, 9 Drawing Sheets

FIG. 15

| | | | |
|---|---|---|---|
| Operator: | ABC OIL CO. | Hole Section: | 6.25 |
| Rig: | 222 | Type: | JACKUP |
| Well: | ABL 429#3 | Loc: | OFFSHORE BLK#299 |
| Rig Supt: | T. SUPER | Rig Mgr: | B. MANAGER |
| Tour Range: | 01/22/98 12 AM - 01/23/98 12 AM | | 147 |

Driller: A. DRILLER

Drilling: Total Feet drilled: 1953 143 Mean ROP: 209

Connections:

| | | | |
|---|---|---|---|
| Total No. of Connections: | 17 | Mean Flow Check time: | 00:00 |
| | | Mean Back Ream time: | 05.33 |
| Mean Wt Off Bit/In Slips: | 00:22 | Mean Circulating before cnct: | 17:59 |
| Mean In Slips/Out Slips: | 03:23 | Mean Multi Shot time: | 00:00 |
| Mean Out Slips/Wt on Bit: | 01:53 | Mean MWD Survey time: | 00:00 |
| True Mean Connection time: | 05:44 | Mean Circulating after cnct: | 00:00 |

Driller: B. DRILLER

Drilling: Total Feet drilled: 1452 145 Mean ROP: 201

Connections:

| | | | |
|---|---|---|---|
| Total No. of Connections: | 15 | Mean Flow Check time: | 00:50 |
| | | Mean Back Ream time: | 05.18 |
| Mean Wt Off Bit/In Slips: | 00:49 | Mean Circulating before cnct: | 00:00 |
| Mean In Slips/Out Slips: | 02:44 | Mean Multi Shot time: | 00:00 |
| Mean Out Slips/Wt on Bit: | 04:18 | Mean MWD Survey time: | 34:38 |
| True Mean Connection time: | 07:21 | Mean Circulating after cnct: | 01:59 |

METHOD OF AND SYSTEM FOR INCREASING DRILLING EFFICIENCY

FIELD OF THE INVENTION

The present invention relates generally to earth boring and drilling and more particularly to a method of and system for increasing the efficiency of boring and drilling operations by measuring the performance of discrete events and operations by drillers and displaying and comparing measures of performance of the drillers.

DESCRIPTION OF THE PRIOR ART

It is very expensive to drill and complete bore holes in the earth such as those made in connection with oil and gas wells. Oil and gas bearing formations are typically located thousands of feet below the surface of the earth. Accordingly, thousands of feet of rock must be drilled through in order to reach the producing formations.

Drilling encompasses many tasks, some of which are repeated thousands of times over the course of completing a 20,000 foot well. In practice, oil and gas wells are drilled in repeated relatively short segments. Each time the drill bit penetrates into the earth the length of a section of drill pipe, the driller stops drilling, raises the drill string, inserts another section of drill pipe into the drill string, and lowers the drill string back into the bore hole so that the bit can begin drilling again. Additionally, the driller must trip the entire drill string out of the bore hole periodically to service the bottom hole assembly or perform other operations. After completing such operations, the driller must trip the entire drill string back into the bore hole before recommencing drilling. In addition to the actual drilling, a number of other operations, such as running and cementing casing, must be performed in order to complete the well.

The cost of drilling and completing a well is primarily time dependent. Drilling contractors typically charge a day rate for their equipment and crews. Thus, the cost of drilling and completing the well is the day rate multiplied by the number of days necessary to drill and complete the well. Some contractors work on a turn-key basis in which they agree to complete a well to a certain depth for a fixed price. The customer's cost, in the day rate situation, or the contractor's profit, in the turn-key situation, depends upon how long it takes to drill and complete the well.

Currently, wells are drilled and completed on a best efforts basis. Drillers and other rig personnel do their jobs in the best way they know how. Some rig personnel are more skillful than others, but improvements in drilling efficiency have been primarily the result of improved technology. For example, improved drill bits have resulted in increases in both bit life and rate of penetration. Increased rates of penetration clearly leads to faster drilling and earlier completion of the well. With increased bit life, the bit can drill for a longer period of time before the drill string must be tripped out of the hole to replace the bit. However, there has been no substantial effort to improve the overall efficiency of oil and gas drilling operations by increasing the overall skill and efficiency of the drilling personnel in their performance of repeatable tasks.

It is an object of the present invention to identify discrete tasks performed in drilling an oil and gas well and to provide a method and system for measuring and tracking the performance of the identified tasks to improve the overall efficiency of operations.

SUMMARY OF THE INVENTION

The present invention provides a method of and system for increasing the efficiency of drillers in performing drilling operations. Briefly stated, method of the present invention, which is implemented in a computer system, measures performance parameters of drilling events performed by the drillers, stores measurements of the performance parameters in a database, and displays a measurement of a selected performance parameter for a selected driller.

In order to show trends, the method may display, graphically or numerically, measurements of one or more selected performance parameters measured over a selected time period for the selected driller. The method may also display an average value of measurements of the selected performance parameters measured over the selected time period for the selected driller. The method may display an explicit indication of a trend in measurements of the selected performance parameters measured over the selected time period. The method may also display comparisons of performance of selected drillers.

BRIEF DESCRIPTION OF THE DRAWINGS

FIG. 15 is an illustration of a drilling summary report according to the present invention.

DESCRIPTION OF THE PREFERRED EMBODIMENT

Figure 1:
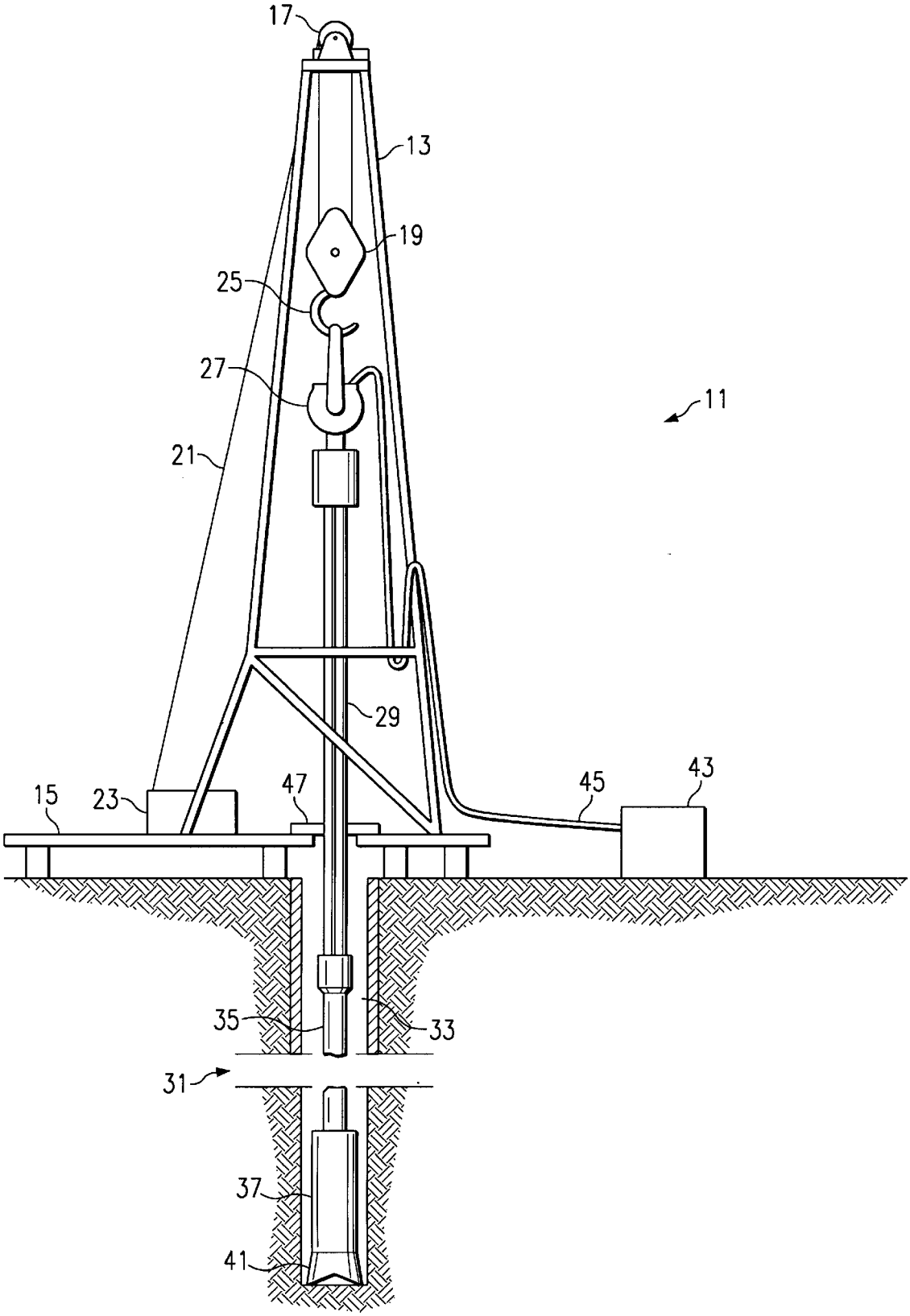
FIG. 1 is a pictorial illustration of a rotary drilling rig.

Referring now to the drawings and first to FIG. 1, a drilling rig is designated generally by the numeral 11. Rig 11 in FIG. 1 is depicted as a land rig. However, as will be apparent to those skilled in the art, the method and system of the present invention will find equal application to non-land rigs, such as jack-up rigs, semisubmersibles, and the like. Also, although a conventional rotary rig is illustrated, those skilled in the art will recognize that the present invention is also applicable to other drilling technologies, such as top drive, power swivel, downhole motor, coiled tubing units, and the like. Rig 11 includes a mast 13 that is supported on the ground above a rig floor 15.

Rig 11 includes lifting gear, which includes a crown block 17 mounted to mast 13 and a traveling block 19. Crown block 17 and traveling block 19 are interconnected by a cable 21 that is driven by draw works 23 to control the upward and downward movement of traveling block 19. Traveling block 19 carries a hook 25 from which is suspended a swivel 27. Swivel 27 supports a kelly 29, which in turn supports a drill string, designated generally by the numeral 31 in a well bore 33. Drill string 31 includes a plurality of interconnected sections of drill pipe 35 a bottom hole assembly (BHA) 37, which includes stabilizers, drill collars, measurement while drilling (MWD) instruments, and the like. A rotary drill bit 41 is connected to the bottom of BHA 37.

Drilling fluid is delivered to drill string 31 by mud pumps 43 through a mud hose 45 connected to swivel 27. Drill string 31 is rotated within bore hole 33 by the action of a rotary table 47 rotatably supported on rig floor 15 and in nonrotating engagement with kelly 29.

Drilling is accomplished by applying weight to bit 41 and rotating drill string 31 with kelly 29 and rotary table 47. The cuttings produced as bit 41 drills into the earth are carried out of bore hole 33 by drilling mud supplied by mud pumps 43.

As is well known to those skilled in the art, the weight of drill string 31 is substantially greater than the optimum weight on bit for drilling. Accordingly, during drilling, drill string 31 is maintained in tension over most of its length above BHA 37. The weight on bit is equal to the weight of string 31 in the drilling mud less the weight suspended by hook 25.

Figure 2:
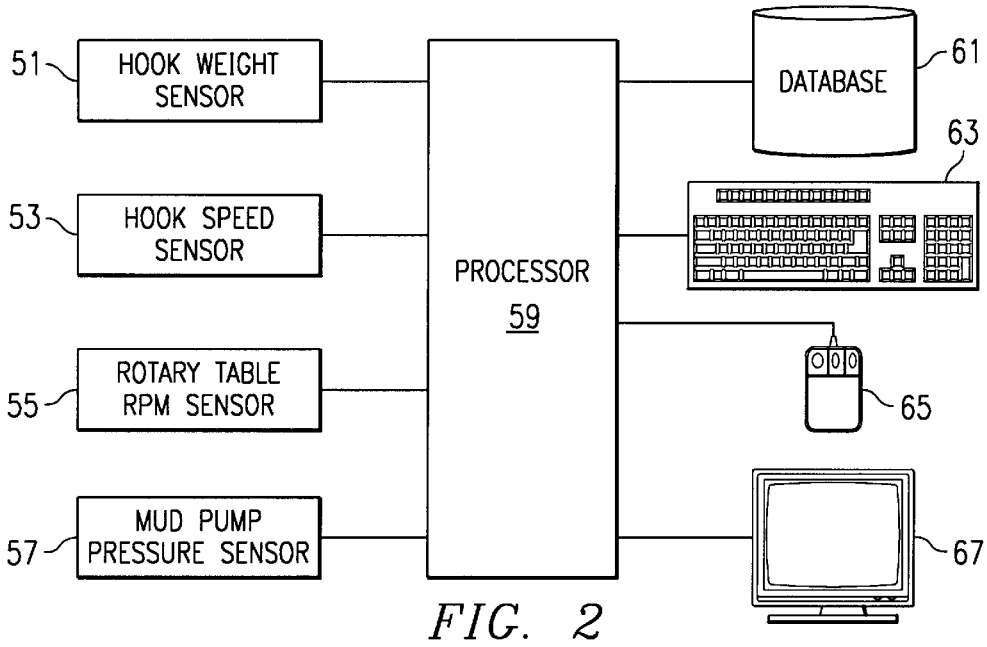
FIG. 2 is a block diagram of a system according to the present invention.

Referring now to FIG. 2, there is shown a block diagram of a preferred system of the present invention. The system includes a hook weight sensor 51. Hook weight sensors are well known in the art. They comprise digital string gauges or the like, that produce a digital weight value at a convenient sampling rate, which in the preferred embodiment is five times per second. Typically, a hook weight sensor is mounted to the static line (not shown) of cable 21 of FIG. 1.

The weight on bit can be calculated by means of the hook weight sensor. As drill string 31 is lowered into the hole prior to contact of bit 41 with the bottom of the hole, the weight on the hook, as measured by the hook weight sensor, is equal to the weight of string 31 in the drilling mud. Drill string 31 is somewhat elastic. Thus, drill string 31 stretches under its own weight as it is suspended in well bore 33. When bit 41 contacts the bottom of bore hole 33, the stretch is reduced and weight is transferred from hook 25 to bit 41.

The driller applies weight to bit 41 effectively by controlling the height or position of hook 25 in mast 13. The driller controls the position of hook 25 by paying out cable from drawworks 23. Referring to FIG. 2, the system of the present invention includes a hook speed sensor. Hook speed sensors are well known to those skilled in the art. An example of a hook speed sensor is a rotation sensor coupled to crown block 17. A rotation sensor produces a digital indication of the magnitude and direction of rotation of crown block 17 at the desired sampling rate. The direction and linear travel of cable 21 can be calculated from the output of the hook position sensor. The speed of travel and position of traveling block 19 and hook 25 can be easily calculated based upon the linear speed of cable 21 and the number of cables between crown block 17 and traveling block 19.

In the manner well known to those skilled in the art, the rate of penetration (ROP) of bit 41 may be computed based upon the rate of travel of hook 25 and the time rate of change of the hook weight. Specifically, $ROP_{bit}=ROP_{hook}+\Lambda dF/dT$, where $ROP_{bit}$ represents the instantaneous rate of penetration of the bit, $ROP_{hook}$ represents the instantaneous speed of hook 25, $\Lambda$ represents the apparent rigidity of drill string 31, and dF/dT represents the first derivative with respect to time of the weight on the hook. The driller can control the rate of penetration of bit 41 by controlling the weight on bit.

The driller can also affect or control the rate of penetration based upon the speed of rotation of rotary table 47 and the pressure of mud pumps 43. Accordingly, referring to FIG. 2, the system in the present invention includes a rotary table RPM sensor 55 and a mud pump pressure sensor 57, each of which outputs a digital value at the desired sampling rate.

In FIG. 2, each sensor 51–57 produces a digital output at the desired sampling rate that is received at a processor 59, which in the preferred embodiment is a personal computer. Processor 59 is programmed according to the present invention to detect events based upon data received from sensors 51–57, make appropriate calculations of drilling performance parameters, and store sampled data, directly measured drilling performance parameters, such as hook speed, as well as calculated drilling performance parameters with appropriate time stamps in a relational database 61.

The system of the present invention enables a user to retrieve from database 61 selected drilling performance parameters, trends in drilling performance parameters, and baseline data for any selected driller or drillers, over any selected time period. User input devices, such as a keyboard 63 and mouse 65, are provided for enabling a user to input information and data into processor 59 as well as operate processor 59 to produce displays and reports according to the present invention, which may be displayed upon a display 67 or printed with a printer 69.

The method and system of the present invention records drilling parameters, such as weight on bit and bit rate of penetration, for each driller so that the driller may improve his ability to achieve and maintain an optimum rate of penetration. In addition to rate of penetration, there are a number of other events under the control of the driller that affect the time required to drill the well. There are a number of operations, such as making connections, tripping in and out of the bore hole, and handling the bottom hole assembly, that the driller and his crew perform as part of drilling operations in which the bit is not advancing into the ground. The time spent in each of those operations adds to the time required to complete the well. According to the present invention, the timing of events in connection with those operations is recorded for each driller.

Figure 3:
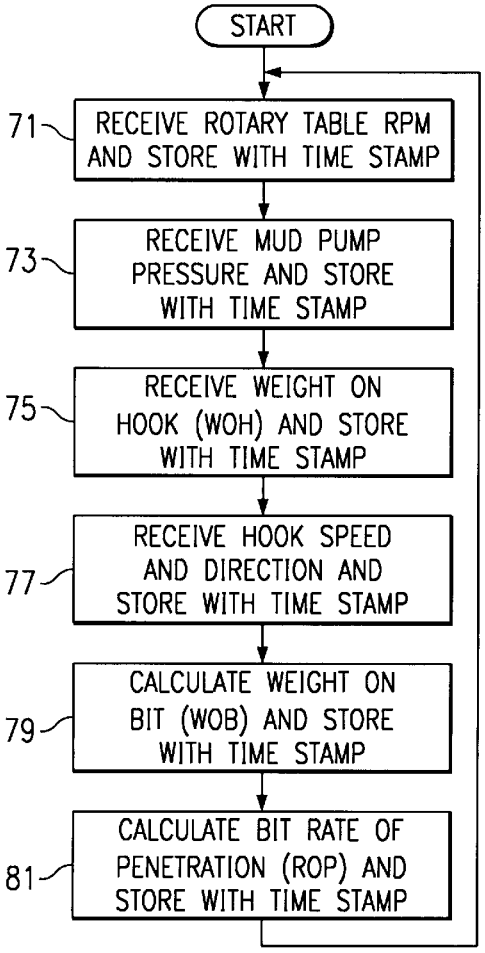
FIG. 3 is a high level flowchart of sensor data processing according to the present invention.

Referring now to FIG. 3, there is shown a high level flow chart of sensor data processing according to the present invention. Sensors 51–57 of FIG. 2 each output a digital value of the parameter they sense at a convenient sampling rate, which in the preferred embodiment is five times per second. The sensor values may be received into a buffer to await processing by processor 59. The system receives the rotary table RPM, mud pump pressure, weight on hook, and hook speed values from the buffers and stores those values with time stamps at blocks 71–77, respectively, of FIG. 3. Then, the system calculates weight on bit and stores the weight on bit value at block 79. Weight on bit is equal to the weight of the string in the mud minus the weight on hook. Then, the system calculates the bit rate of penetration (ROP) and stores the calculated ROP with a time stamp at block 81. ROP is calculated by adding the product of the apparent rigidity of the drill string and the time rate of change of the weight on hook to the instantaneous hook speed received at block 77. After the system has calculated ROP, processing returns to block 71 to receive another set of sensor data. The system loops through FIG. 3 processing about five times per second.

Figure 4:
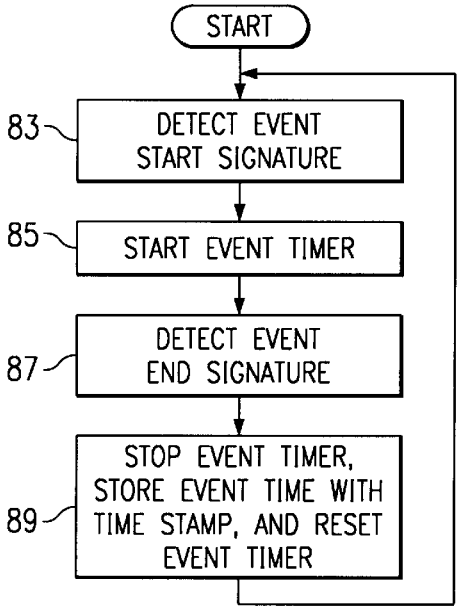
FIG. 4 is a high level flowchart of event timer processing according to the present invention.

Referring now to FIG. 4, there is shown event processing according to the present invention. Generally, events are activities such as drilling, making connections, tripping out of the hole, bottom hole assembly handling, and tripping into the hole. An event may comprise subevents. For example, a connection event begins when the bit is lifted off the bore hole bottom and ends when the bit reaches the bottom again to recommence drilling. However, according to the present invention, a single connection event comprises the time spent raising the string to the slips, the time the string spends in the slips, and the time spent lowering the bit back to the bottom.

The system detects an event start signature at block 83. A signature is a particular combination of sensor values that indicates the occurrence of an event. The system of the present invention includes logic that is triggered by the detection of an event signature. When the system detects an event start signature, the system starts an event timer, at block 85. Then, the system implicitly waits for the detection of an event in the signature, at block 87. When the system detects an event and signature, the system stops the event timer, stores the event time with a time stamp, and resets the event timer at block 89.

An end signature for one event may be a start signature for another event. For example, in connections, the signature that indicates that the string is supported by the slips signals the end of raising the string and the beginning of the time spent in the slips. Accordingly, in the preferred embodiment of the present invention, events are processed as separate processes.

The data recorded in and accessible from database 61 are listed along with their respective formats as follows:

| | |
|---|---|
| Data Retrieved Date and Time | Date/Time |
| Tour Change Time | Date/Time |
| Tour Begin Time | Date/Time |
| Comments | Number (Long) |
| Rig Activity | Number (Byte) |
| Rig Activity - Drilling | Number (Long) |
| Rig Activity - Circulating | Number (Long) |
| Rig Activity - Testing BOPE | Number (Long) |
| Rig Activity - Rigging Up Casing | Number (Long) |
| Rig Activity - Running Casing | Number (Long) |
| Rig Activity - Rigging Up Cement | Number (Long) |
| Rig Activity - Cementing | Number (Long) |
| Rig Activity - Drive Pipe Welding Time | Number (Long) |
| Rig Activity - Connect | Number (Double) |
| Rig Activity - Other | Number (Long) |
| Drilling - Feet | Number (Long) |
| Drilling - Avg ROP this tour | Number (Long) |
| Drilling - Avg ROP last tour | Number (Long) |
| Drilling - Avg ROP this hole section | Number (Long) |
| Drilling - Rotating hours on bottom | Number (Long) |
| Drilling - Total rotating hours | Number (Long) |
| Connections - Num Connections this tour | Number (Integer) |
| Connections - Avg Wt off Bit to In Slips this tour | Number (Single) |
| Connections - Avg Flow Check time this tour | Number (Single) |
| Connections - Avg Back Ream Time this tour | Number (Single) |
| Connections - Avg Circulating before connect this tour | Number (Single) |
| Connections - Avg In Slips to Out of Slips this tour | Number (Long) |
| Connections - Avg Multi Shot time this tour | Number (Long) |
| Connections - Avg Out of Slips to Wt on Bit this tour | Number (Long) |
| Connections - Avg MWD Survey time this tour | Number (Long) |
| Connections - Avg Circulating after connect this tour | Number (Long) |

-continued

| | |
|---|---|
| Connections - Avg Connection time this tour | Number (Long) |
| Connections - Avg Wt Off Bit to In Slips this well | Number (Long) |
| Connections - Avg Flow Check time this well | Number (Long) |
| Connections - Avg Back Ream time this well | Number (Long) |
| Connections - Avg Circulating before connect this well | Number (Long) |
| Connections - Avg In Slips to Out of Slips this well | Number (Long) |
| Connections - Avg Multi Shot time this well | Number (Long) |
| Connections - Avg Out of Slips to Wt on Bit this well | Number (Long) |
| Connections - Avg MWD Survey time this well | Number (Long) |
| Connections - Avg Circulating after connect this well | Number (Long) |
| Connections - Avg Connection time this well | Number (Long) |
| Connections - Total Avg Connect this tour | Number (Single) |
| Connections - Total Avg Connect this well | Number (Single) |
| Tripping Out - Avg Slip/Slip time this trip out | Number (Long) |
| Tripping Out - Avg Slip/Slip time last trip out | Number (Long) |
| Tripping Out - Avg Slip/Slip time this hole section | Number (Long) |
| Tripping Cut - Avg Stand Time this trip out | Number (Long) |
| Tripping Out - Avg Stand Time last trip out | Number (Long) |
| Tripping Out - Avg Stand Time this hole section | Number (Long) |
| Tripping Out - Avg Pipe Velocity this trip out | Number (Single) |
| Tripping Out - Max Pipe Velocity this trip out | Number (Single) |
| Tripping Out - Trip Out Time | Number (Long) |
| Tripping In/Out - Slip/Cut Drill Line | Number (Long) |
| Tripping In/Out - Testing BOPE | Number (Long) |
| Tripping In/Out - Testing Casing | Number (Long) |
| Tripping In/Out - Rig Maintenance | Number (Long) |
| Tripping In/Out - Shallow Testing of MWD | Number (Long) |
| Tripping In/Out - Breaking Circulation | Number (Long) |
| Tripping In/Out - Circulating | Number (Long) |
| Tripping In/Out - Working as Directed | Number (Long) |
| Tripping In/Out - Other | Number (Long) |
| BHA Handling - Total Handling Time | Number (Long) |
| BHA Handling - Download MWD | Number (Long) |
| BHA Handling - Change Out MWD | Number (Long) |
| BHA Handling - Change Out Mud Motor | Number (Long) |
| BHA Handling - Pull Wear Bushing | Number (Long) |
| BHA Handling - Retrieve Survey | Number (Long) |
| BHA Handling - Rig Maintenance | Number (Long) |
| BHA Handling - Testing BOPE | Number (Long) |
| BHA Handling - Waiting On Orders | Number (Long) |
| BHA Handling - Qrienting Mud Motor | Number (Long) |
| BHA Handling - Nozzle Change | Number (Long) |
| BHA Handling - Surface Testing MWD/LWD | Number (Long) |
| BHA Handling - Working as Directed | Number (Long) |
| BHA Handling - Other | Number (Long) |
| Tripping In - Avg Slip/Slip time this trip in | Number (Long) |
| Tripping In - Avg Slip/Slip time last trip in | Number (Long) |
| Tripping In - Avg Slip/Slip time this hole section | Number (Long) |
| Tripping In - Avg Stand Time this trip in | Number (Long) |
| Tripping In - Avg Stand Time last trip in | Number (Long) |
| Tripping In - Avg Stand Time this hole section | Number (Long) |
| Tripping In - Avg Pipe Velocity this trip in | Number (Single) |
| Tripping In - Max Pipe Velocity this trip in | Number (Single) |
| Tripping In - Trip In Time | Number (Long) |
| Hole Depth | Number (Single) |
| Driller ID | Number (Integer) |
| BitType | Number (Integer) |
| HoleSize | Number (Single) |
| WellID | Number (Integer) |
| RigManagerID | Number (Long) |
| BitROP | Number (Single) |
| RPM | Number (Single) |
| WOB | Number (Single) |
| PumpPressure | Number (Single) |
| RigTeam | Number (Integer) |
| RT_WtOffInSlip | Number (Single) |
| RT_InOutSlip | Number (Single) |
| RT_OutSlipsWtOnBot | Number |
| (Single) RT_TrueConnection | Number (Single) |
| RT_TripInSlipSlip | Number (Single) |
| RT_TripInStandTime | Number (Single) |
| RT_TripOutSlipSlip | Number (Single) |
| RT_TripOutStandTime | Number (Single) |
| AvgPipeRun | Number (Single) |
| BHA Handling - Change BHA | Number (Long) |

Figure 5:
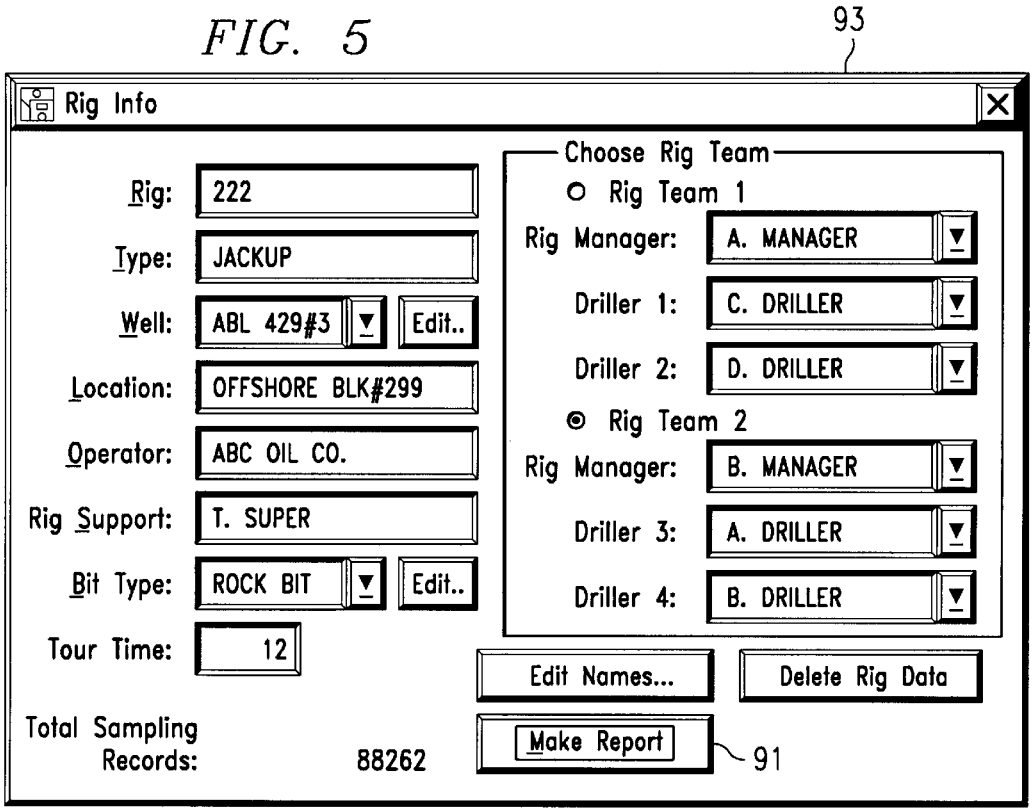
FIG. 5 is an illustration of a rig information window according to the present invention.

The present invention provides a graphical user interface by which selected drilling performance parameters and trends in performance parameters for a selected driller or drillers, as well as baseline data, may be displayed, in either graphical or numerical form. Referring now to FIG. 5, there is shown a rig information window designated generally by the numeral 93. The rig information window of FIG. 5 displays information with respect to a particular well being drilled by a particular rig. The rig information window includes a make report control 91 that enables a user to select a report according to the present invention. Clicking make report control 91 causes the system to display a report types window 95 illustrated in FIG. 6. Report types window 95 includes a list of report types.

Figure 6:
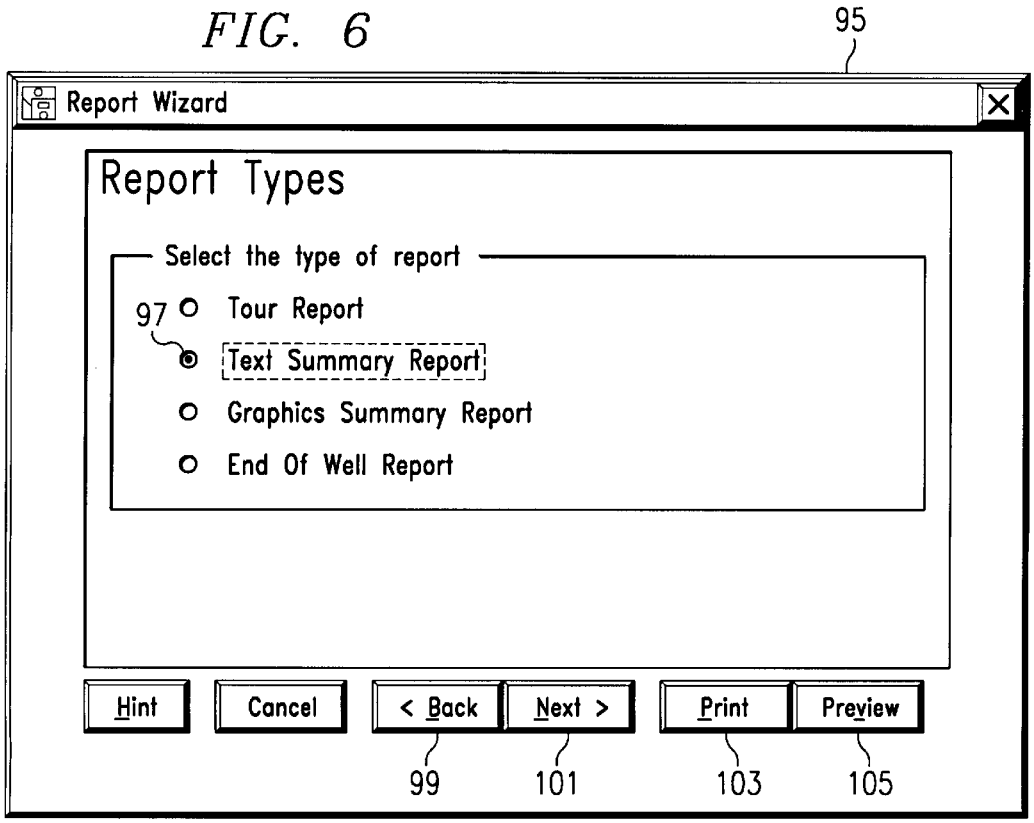
FIG. 6 is an illustration of a report types selection window according to the present invention.

As shown in FIG. 6, in the preferred embodiment, the report types include a tour report, a text summary report, a graphics summary report, and an end of well report. Each report type is associated with a control that enables the user to select a desired report. As shown in FIG. 6, the user has selected the text summary report by clicking control 97. Report types window 95 includes a back control 99 and a next control 101. Since report types window 95 is the first window in the report generation sequence of windows, back control 99 is disabled. Report types window also includes a print control 103 and a preview control 105, which are also disabled in window 95. After the user has selected the desired report type, clicking on next button 101 causes the system to display a report selection window.

Figure 7:
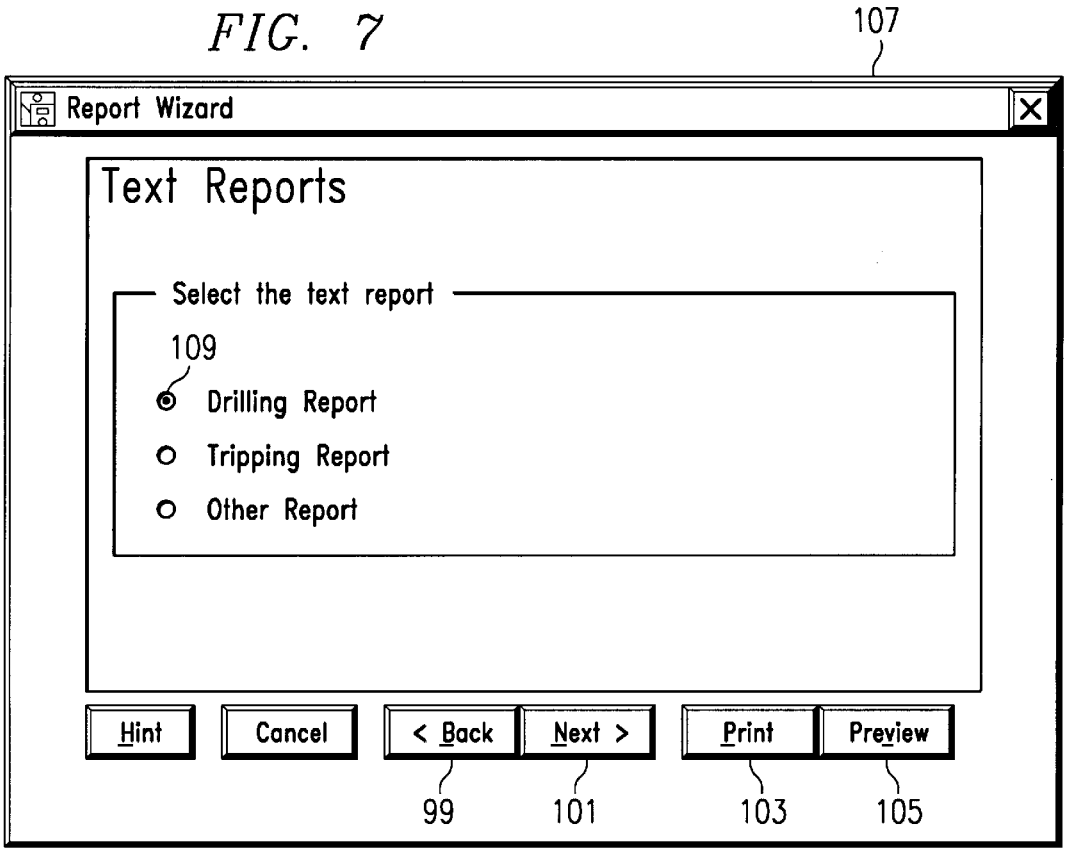
FIG. 7 is an illustration of a text reports selection window according to the present invention.

Referring now to FIG. 7, a text reports selection window is designated generally by the numeral 107. Text reports window 107 is generally similar to report types window 95 in that it includes a back control 99, a next control 101, a print control 103, and a preview control 105. Print control 103 and preview control 105 are disabled in text reports selection window 107. Text reports window 107 includes a list of text reports, as opposed to graphics reports, that are supported by the present invention. In the preferred embodiment, the text reports include a drilling report, a tripping report, and an other report. Controls are associated with the reports listed in text reports window 107 that enable the user to select a report. As shown in FIG. 7, the user has selected the drilling text report by clicking a control 109. After the user has selected the desired text report, clicking next control 101 causes the system to display a time range selection window shown in FIG. 8 and designated generally by the numeral 11.

Figure 8:
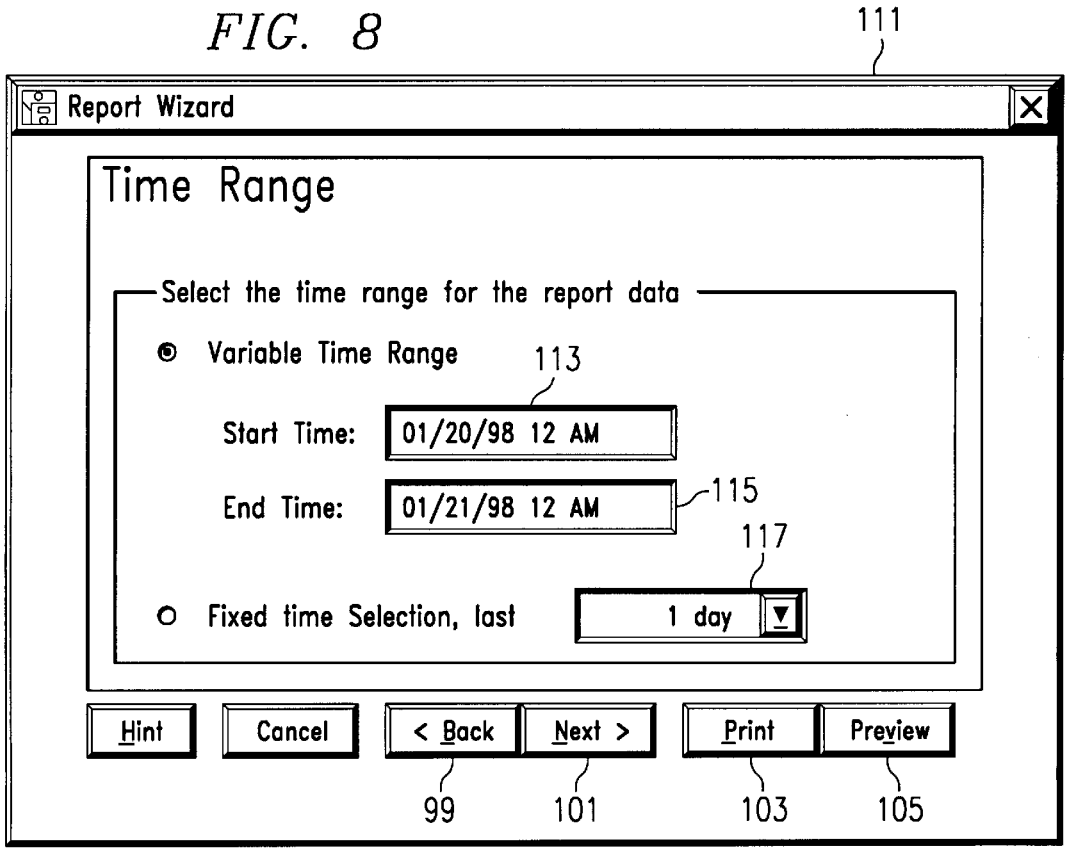
FIG. 8 is an illustration of a time range selection window according to the present invention.
Figure 9:
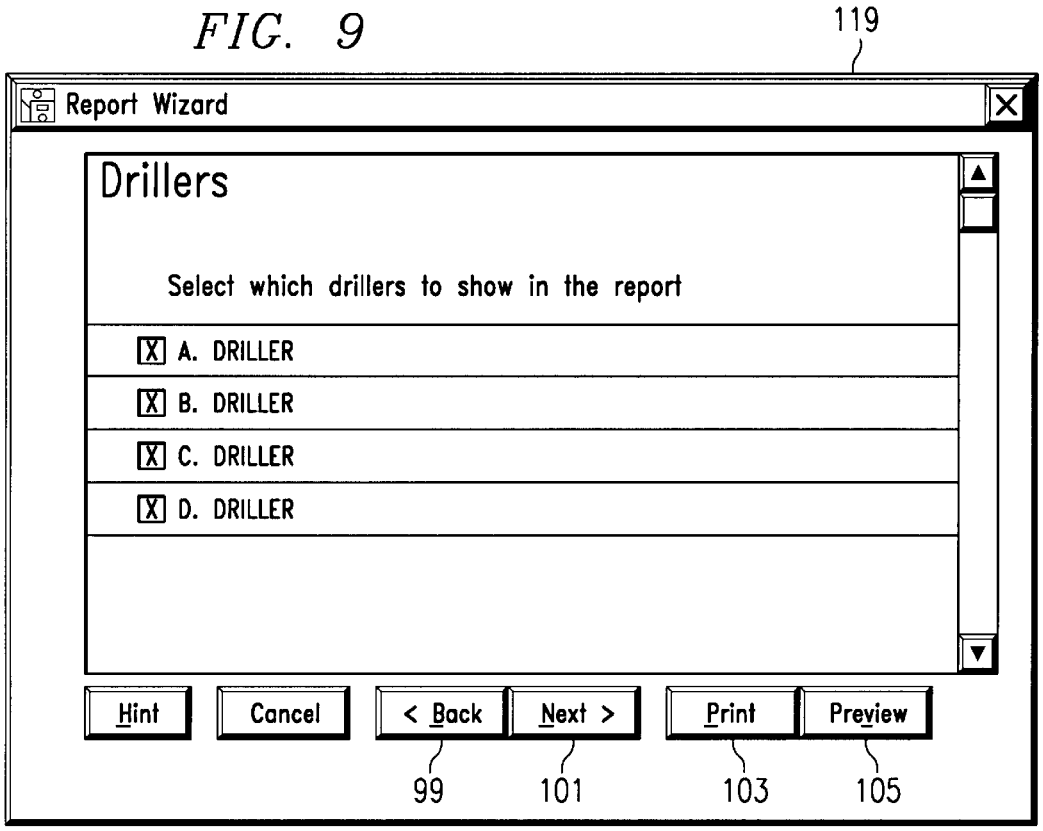
FIG. 9 is an illustration of a driller selection window according to the present invention.

Referring to FIG. 8, time range window enables the user to select a time range for the report. The user may select a variable time by entering a time in a start time entry field 113 and entering a later time in an end time entry field 115. The user may also select a fixed time from a pull down menu 117. After the user has selected a time range for the report and clicks next button 101, the system displays a driller selection window shown in FIG. 9 and designated generally by the numeral 119. Referring to FIG. 9, driller selection window 119 includes a list of drillers. A check box control is associated with each driller on the list. Driller selection window 119 supports multiple selections. Accordingly, the user can select a single driller or multiple drillers for comparison purposes. After the user has selected the driller or drillers, clicking on next button 101 causes the system to display a hole selection window designated generally by the numeral 121 in FIG. 10. Hole selection window displays a list of hole sections or diameters in the well. Each hole section in the list includes a check box that enables the user to select any or all of the whole sections displayed. Hole selection window 121 is the last window in the report generation sequence of windows. Accordingly, next control 101 is disabled. However, back control 99, print control 103 and preview control 105 are enabled. Clicking on preview control 105 causes the system to display the report. In the sequence just illustrated, with respect to FIGS. 7–10, the system would display a text drilling report for the time range commencing at 12:00 a.m. Jan. 20, 1998 and ending at 12:00 a.m. Jan. 21, 1998 for drillers A–D in hole sections 6.25 inches–8.5 inches. An example of a drilling report is illustrated in FIG. 15. Selection of print button 103 in FIG. 10 causes the system to print the report.

Figure 10:
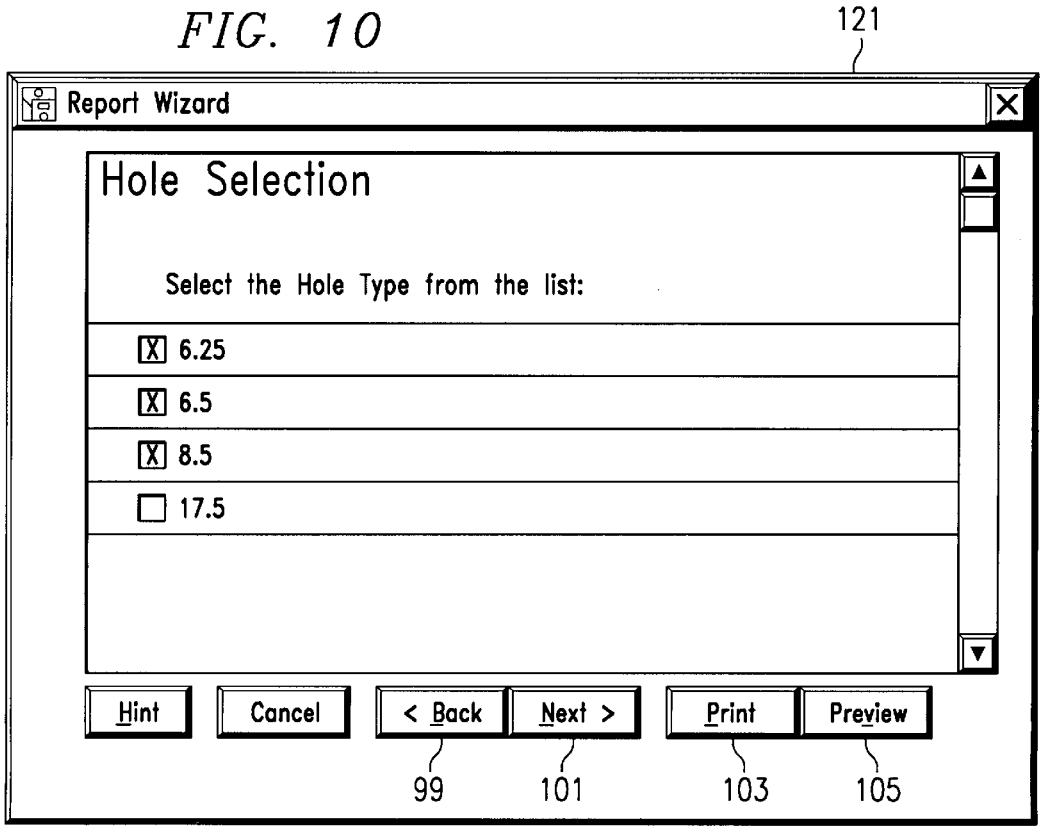
FIG. 10 is an illustration of a hole type selection window according to the present invention.
Figure 11:
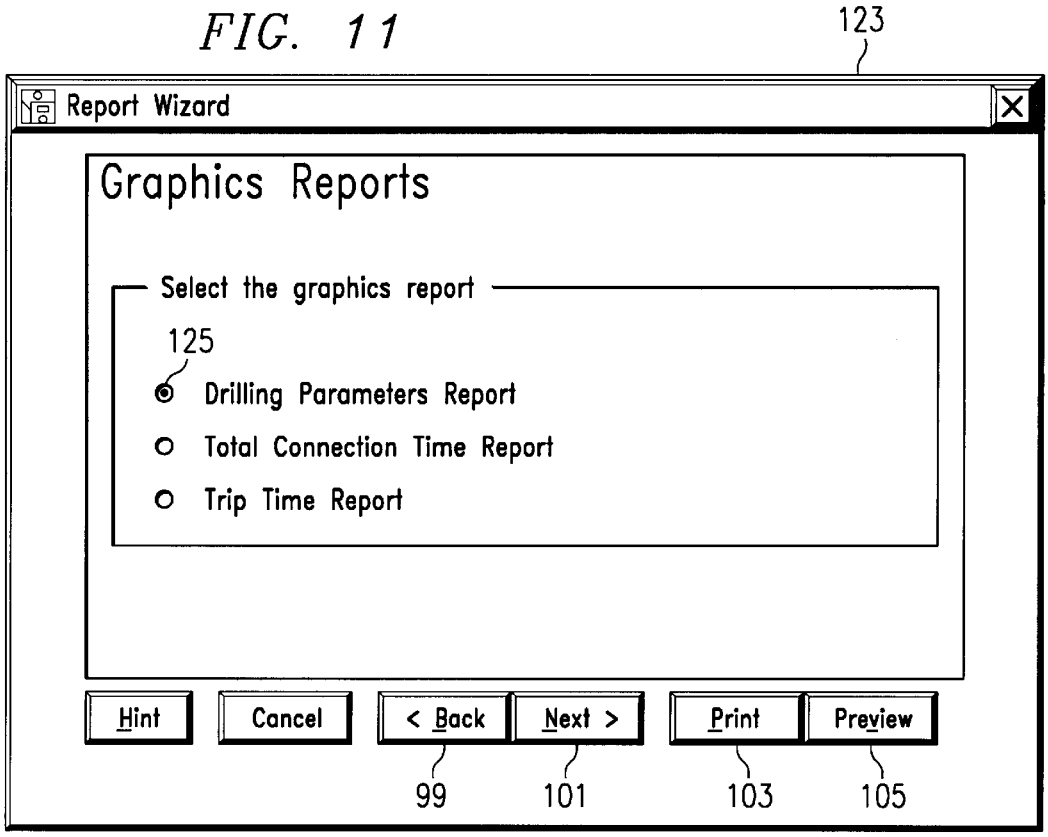
FIG. 11 is an illustration of a graphics reports selection window according to the present invention.

Referring now to FIG. 11, graphics reports selection window is designated generally by the numeral 123. The system displays graphics reports window 123 in response to selection of the graphics summary report item in report types window 95, shown in FIG. 6. Graphics reports window 123 includes a listing of graphical reports according to the present invention. In the preferred embodiment, the graphics reports include a drilling parameters report, a total connection time report, and a trip time report. A control is associated with each report listed in graphics reports window 123. As shown in FIG. 11, the user has selected the control 125 associated with the drilling parameters report. When the user clicks next control 101, the system returns to the sequence of windows illustrated in FIGS. 8–10 so that the user may select a time range, a driller or drillers, and a hole section or sections, respectively.

Figure 12:
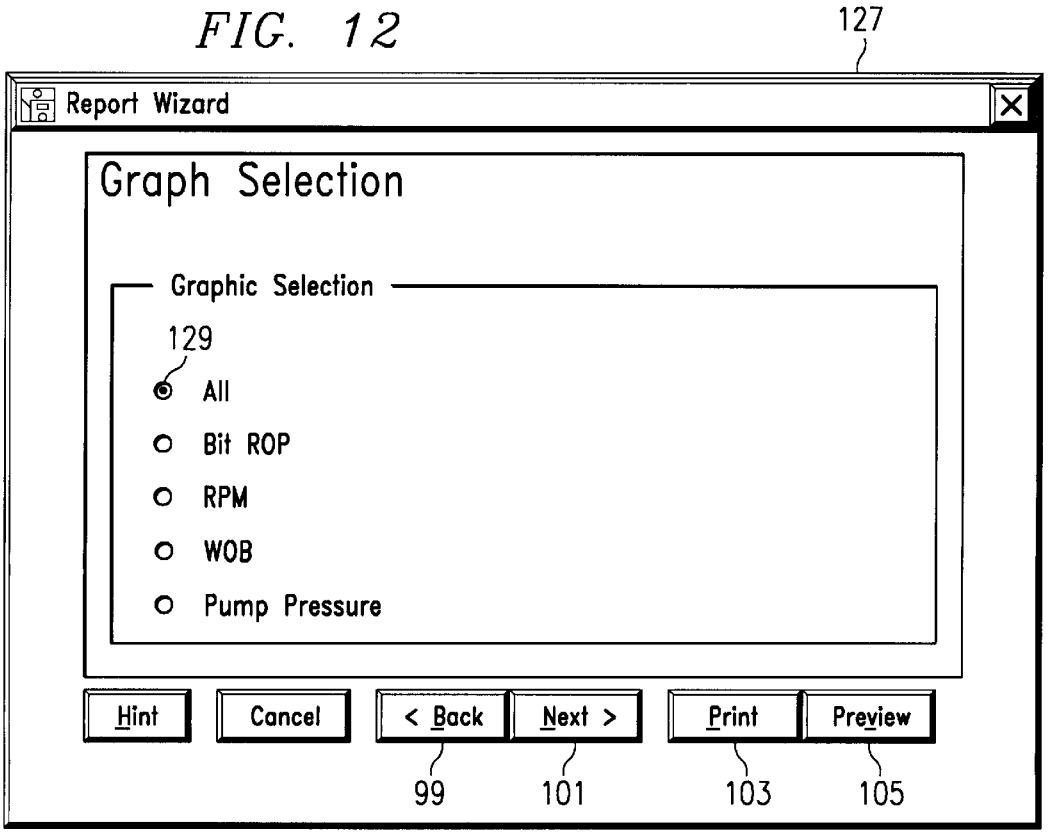
FIG. 12 is an illustration of a graph selection window according to the present invention.

When the user has completed hole section selection according to FIG. 10, the system displays a graph selection window illustrated in FIG. 12 and designated generally by the numeral 127. Graph selection window includes a listing of the graphical display supported by the present invention. In the preferred embodiment, the graphical displays include bit ROP, RPM, WOB, and pump pressure. The graph selection list also includes an ALL selection choice which enables the user to select all of the choices for display. A control is associated with each graphic selection item in graph selection window 127. As shown in FIG. 12, the user has selected the control 129 associated with the ALL choice.

Figure 13:
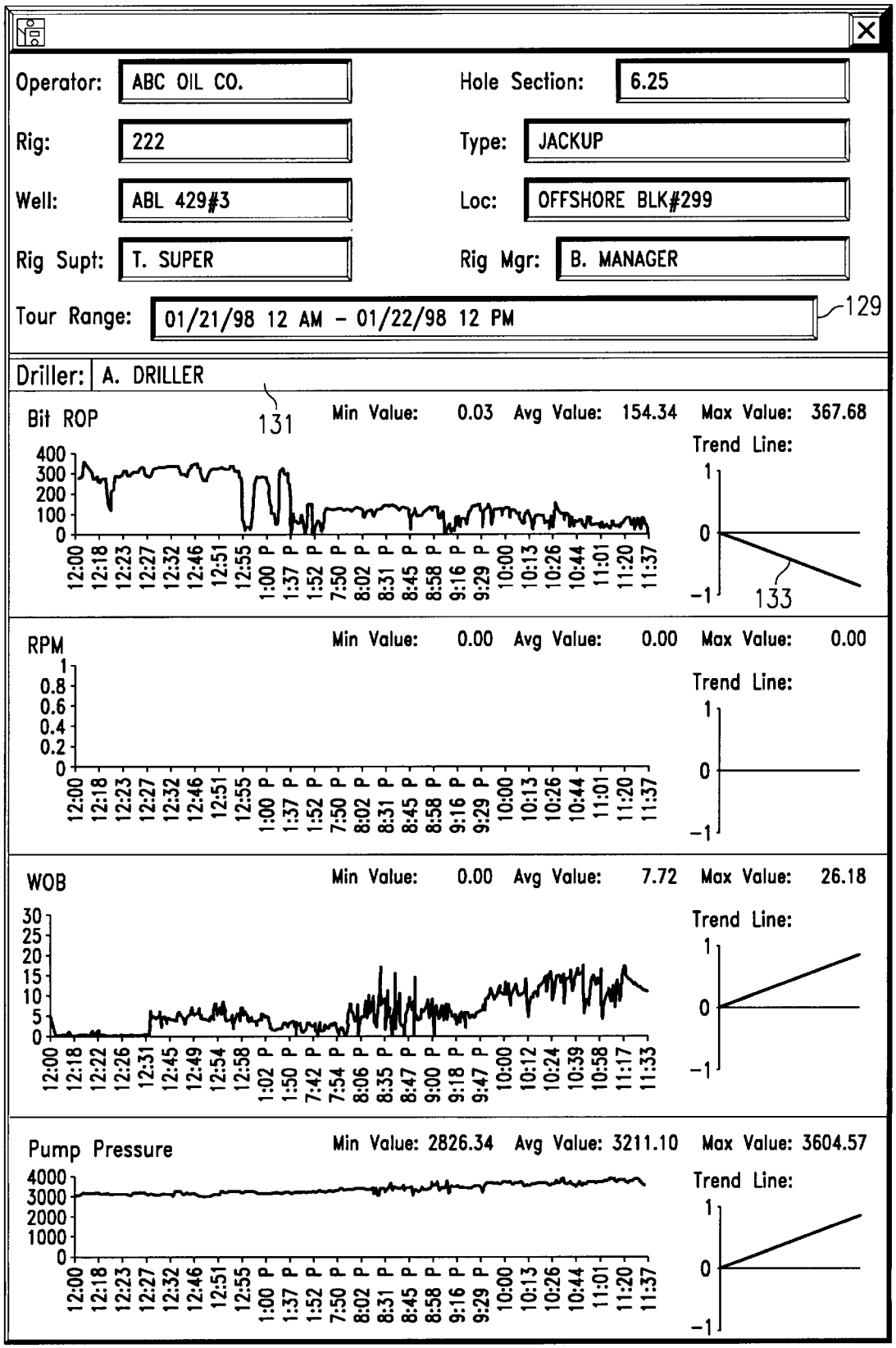
FIG. 13 is an illustration of a drilling parameters report according to the present invention.

Referring now to FIG. 13, there is illustrated a drilling parameters report according to the present invention. The drilling parameters report contains a plurality of fields including a tour range field 129 and driller field 131. The drilling parameters report provides a graphical representation of the drilling performance of a selected driller identified in driller field 131 over a selected tour identified in tour range field 129.

The report of FIG. 13 may be either displayed on display 67 or printed with printer 69 of FIG. 2. As shown in FIG. 13, the drilling parameters report provides graphic representations of bit ROP, RPM, WOB over the tour of the selected driller that commenced 12:00 a.m. Jan. 21, 1998 and ended at 12:00 p.m. Jan. 22, 1998. The drilling parameters are displayed graphically by means of line graphs and numerical values are displayed for the minimum, average, and maximum value of each drilling parameter. The drilling parameters report of FIG. 13 also displays for each drilling parameter a trends line 133, which is a graphical indication of the trend in the selected drilling parameter over the course of the tour. As shown in FIG. 13, with respect to bit ROP, the selected driller achieved an average bit ROP of 154.34 feet per hour, with a minimum value of 0.03 feet per hour and a maximum value of 367.68 feet per hour, with a downward trend over the tour. With respect to WOB, the selected driller maintained an WOB of 7.72 thousand pounds, with a minimum value of 0.00 thousand pounds and a maximum value of 26.18 thousand pounds, with an upward trend over the tour. The information in the drilling parameters report of FIG. 13 may be used to improve the efficiency of the selected driller identified in driller field 131.

Figure 14:
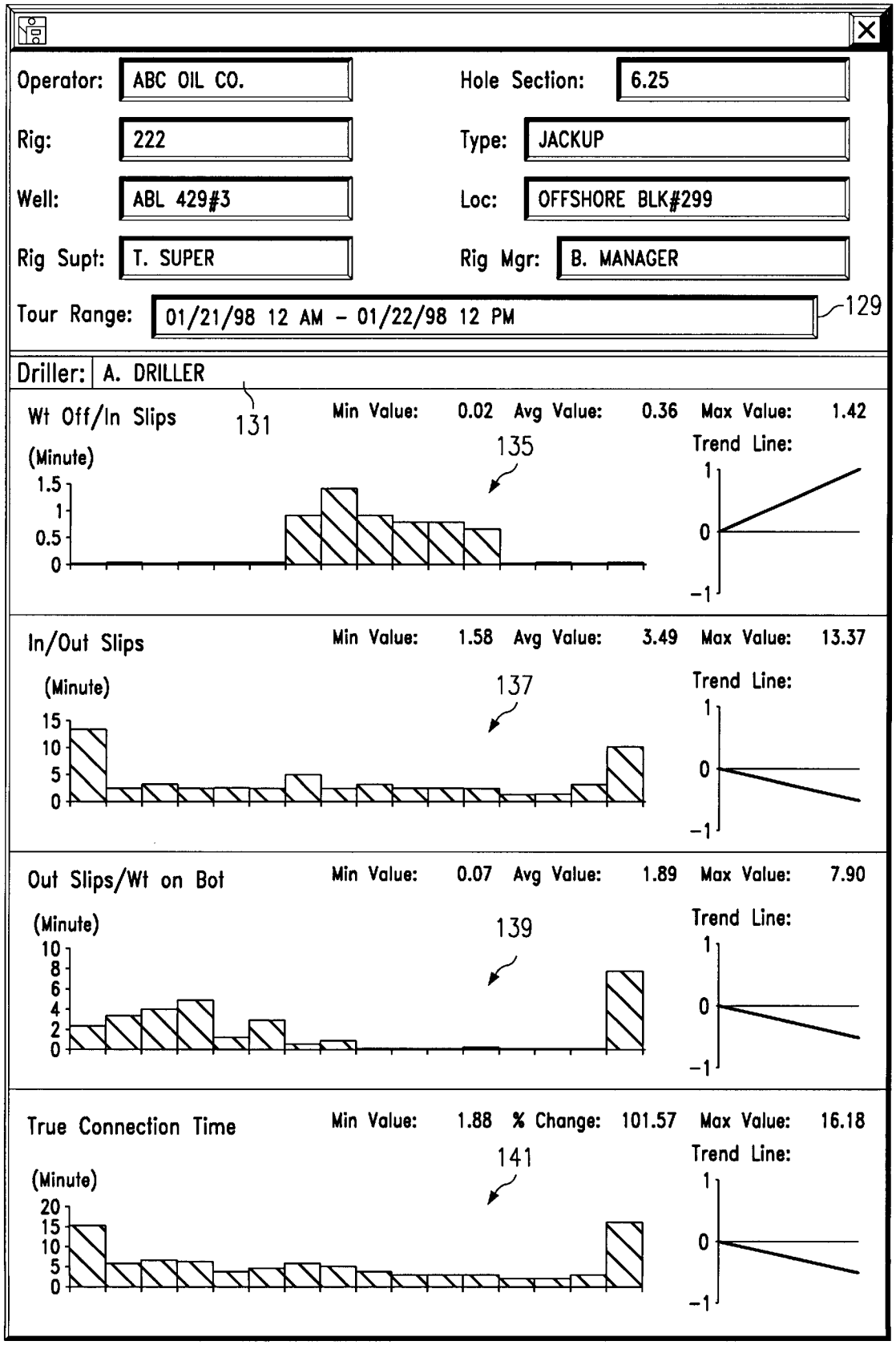
FIG. 14 is an illustration of a total connection time report according to the present invention.

Referring now to FIG. 14, there is shown an illustration of a total connection time report according to the present invention. The total connection time report of FIG. 14 provides a graphical representation of the time taken by the selected driller identified in driller field 131 and his crew during the tour identified in tour range field 129. When the total connection report of FIG. 14 is generated, bar graphs are generated from the data stored in the database. The total connection time report of FIG. 14 includes bar graphs 135–141 that indicate for each connection over the course of the tour the time from weight off the bottom until the string went into the slips, the time the string spent in the slips, the time from when the string came out of the slips, and the true correction time, which reflects the total time for each connection over the course of the tour. The total connection time report also displays trend lines for each of the connection subevents.

Referring now to FIG. 15, there is shown a drilling summary report according to the present invention. The drilling summary report displays in numerical format a comparison of the drilling and connection performance of a first selected driller, identified in an driller field 143, and a second selected driller, identified in a driller field 145, over the course of the tour range identified in tour range field 147. As shown in FIG. 15, the driller identified as "A. Driller" achieved somewhat higher mean ROP over the course of his tour than the driller identified as "B. Driller." However, A. Driller drilled substantially more total feet during his tour. By comparing the connections parameters for A. Driller and B. Driller, it is apparent that a large part of A. Driller's advantage in total feet drilled is due to A. Driller's faster true mean connection time. FIG. 15 illustrates how the method and system of the present invention may be used to identify problems or inefficiencies and improve the overall drilling process.

As will be apparent from the foregoing description, the present invention provides a method and system by which any of the parameters recorded in the database may be displayed to improve the performance of selected drillers. The foregoing description is illustrative of the invention and not limiting. Accordingly, the true spirit and scope of the invention shall be determined according to the appended claims.

What is claimed is:

1. A method of increasing the efficiency of drilling personnel in performing drilling operations, which comprises the computer implemented steps of:

measuring performance parameters of drilling events performed by one or more individual drillers selected from a plurality of said drilling personnel;

storing measurements of said performance parameters in a database; and, displaying a measurement of a selected performance parameter for a selected driller.

2. The method as claimed in claim 1, including the computer implemented step of:

displaying measurements of said selected performance parameter measured over a selected time period for a selected driller.

3. The method as claimed in claim 1, including the computer implemented step of:

displaying an average value of measurements of said selected performance parameter measured over a selected time period for said selected driller.

4. The method as claimed in claim 1, including the computer implemented step of:

displaying an indication of a trend in measurements of said selected performance parameter measured over said selected time period for said selected driller.

5. The method as claimed in claim 1, including the computer implemented step of:

displaying measurements of said selected performance parameters over said selected time period for said selected driller numerically.

6. The method as claimed in claim 1, including the computer implemented step of:

displaying said measurements of said selected performance parameters over said selected time period for said selected driller graphically.

7. The method as claimed in claim 1, wherein said selected performance parameter is bit rate of penetration.

8. The method as claimed in claim 1, wherein said selected performance parameter is weight on bit.

9. The method as claimed in claim 1, wherein said selected performance parameter is connection time.

10. The method as claimed in claim 9, wherein said selected performance parameter includes average connection time over a selected time period.

11. A method of improving the efficiency of drilling personnel in performing drilling operations, which comprises the computer implemented steps of:

measuring performance parameters of drilling events performed by one or more individual drillers selected from a plurality of said drilling personnel;

storing measurements of said performance parameters in a database;

displaying a list of report types for selection by a user;

in response to user selection of a report type, displaying a list of reports within the selected report type for selection by said user;

in response to user selection of a report from said list of reports, prompting said user to select a time range;

in response to user selection of a time range, displaying a list of drillers for the selected time range;

in response to use selection from said list of drillers, displaying the selected report for the selected time range for the selected driller.

12. The method as claimed in claim 11, wherein said list of report types includes a text summary report type and graphics summary report type.

13. The method as claimed in claim 12, wherein said text summary report type includes a drilling report and a tripping report.

14. The method as claimed in claim 12, wherein said graphics summary report type includes a drilling parameters report.

15. The method as claimed in claim 14, including the computer implemented step of:

in response to user selection of said drilling parameters report, displaying a list of selectable drilling parameters.

16. The method as claimed in claim 15, wherein said list of selectable drilling parameters includes a bit rate of penetration parameter and a weight on bit parameter.

17. A system for improving the efficiency of drilling personnel in performing drilling operations, which comprises:

sensors arranged to sense hook weight and hook position;

means for sampling at periodic times hook weight and hook position values sensed by said sensors;

means for determining drilling parameter values based upon sampled hook weight and hook position values;

a relational databases for storing said drilling parameter values; and, means for displaying selected drilling parameters for one or more individual drillers selected from a plurality of said drilling personnel.

* * * * *